United States Patent [19]

Bosch

[11] 4,322,702

[45] Mar. 30, 1982

[54] ELECTROMAGNETIC RELAY

[75] Inventor: Werner Bosch, Munich, Fed. Rep. of Germany

[73] Assignee: Siemens Aktiengesellschaft, Berlin & Munich, Fed. Rep. of Germany

[21] Appl. No.: 187,167

[22] Filed: Sep. 15, 1980

[30] Foreign Application Priority Data

Oct. 19, 1979 [DE] Fed. Rep. of Germany ... 7929700[U]

[51] Int. Cl.[3] ..... H01H 9/02; H01H 13/04

[52] U.S. Cl. ..... 335/202; 335/294; 335/278; 361/358; 174/50; 220/3.8; 206/328

[58] Field of Search ..... 335/202, 294, 162, 278, 335/292; 361/357, 403, 358, 359; 200/51 R; 220/3.8, 3.94; 362/154; 174/17 R, 17 CT, 50, 52 R

[56] References Cited

U.S. PATENT DOCUMENTS

| | | | |
|---|---|---|---|
| 2,832,498 | 4/1958 | Parsons | 224/42.42 R X |
| 3,176,062 | 3/1965 | Nordström et al. | 174/52 R |
| 3,694,674 | 9/1972 | Inoue | 174/52 R X |

FOREIGN PATENT DOCUMENTS 2332989 9/1978 Fed. Rep. of Germany .

*Primary Examiner*—L. T. Hix
*Assistant Examiner*—Stafford D. Schreyer
*Attorney, Agent, or Firm*—Hill, Van Santen, Steadman, Chiara & Simpson

[57] ABSTRACT

A housing for an electromagnetic relay is disclosed which has the shape of a trough and is closeable by means of a flat cover. For fastening the cover on the housing, two holding lugs are shaped on the housing. The mounting of the cover proceeds by means of insertion under the holding lugs.

11 Claims, 4 Drawing Figures

ELECTROMAGNETIC RELAY

BACKGROUND OF THE INVENTION

The invention concerns an electromagnetic relay with a trough-shaped base body or member consisting of insulating material, which serves as a carrier for the functional elements of the relay and which is closeable by means of a flat cover which is supported at least partially on the edge of the base member.

A relay of this sort is already known from German Pat. No. 2,332,989, incorporated herein by reference. The advantage of such a construction is that the cover can be punched from a sheet or film in the shape of a flat plate. Therefore, this cover is significantly simpler and cheaper to manufacture than other covers with edges which are shaped on or with holding elements which must be manufactured by means of injection molding or similar methods. For anchoring the cover in the case of the known relay, on the yoke of the magnet a holding element is shaped for example, similar to a dove tail and which is brought into engagement with a perforation in the cover. The stamping of the yoke of the magnet with the holding element shaped on nevertheless brings about a relatively rapid wear of the tool; besides this, it is unfavorable for some applications if the holding element is accessible as a metallic part on the surface of the relay. When voltage-carrying parts are arranged in the vicinity, therefore, an additional insulation must be provided.

SUMMARY OF THE INVENTION

It is an object of the invention to design a relay of the kind described above with a cover in the shape of a flat plate in such manner that no metal parts appear on the surface of the housing for the holding of the cover. According to the invention, this problem is solved in that on the base member, two holding lugs are shaped on which overlap the surface of the cover in directions opposing one another.

These holding lugs can be shaped onto the housing during its manufacture in the transfer molding process or a corresponding method. In this manner, the punching of the yoke is simplified and simultaneously the insulation of the relay housing is improved.

Under certain circumstances it is advantageous that the cover displays recesses which are displaced with respect to the holding lugs and which correspond to their size. Such recesses can be dispensed with if the holding lugs are provided on the housing edge. In another embodiment, however, the holding lugs are arranged in a practical manner on an intermediate wall approximately in the middle of the housing. In this case, a recess of the cover which narrows in the direction of insertion is advantageous. The cover is thereby placed with the recess over the holding lugs and is fastened by means of a simple sliding on. In a practical further development, besides this it is provided that ribs corresponding to the size of the recesses are provided in the housing, displaced with respect to the lugs. These ribs after sliding on of the cover lie under the recess so that the relay remains protected against dust despite the recess in the cover.

DESCRIPTION OF THE PREFERRED EMBODIMENTS

Figure 1:
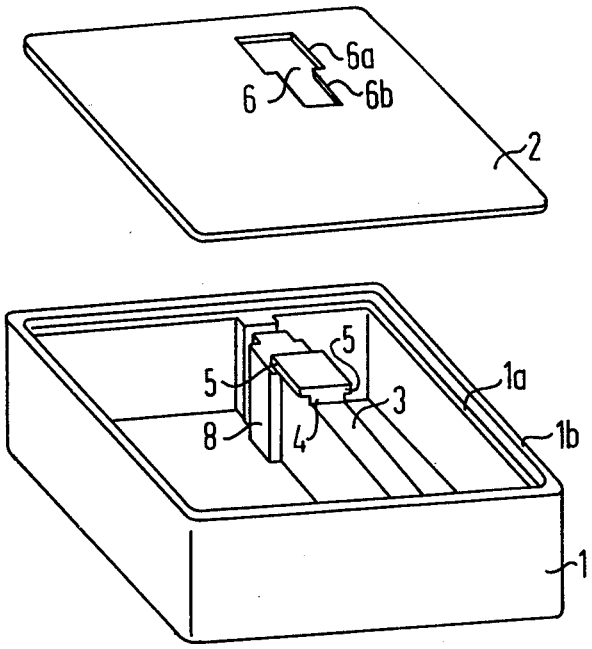
FIG. 1 shows a relay housing with cover in accordance with the invention.

FIG. 1 shows a relay housing 1 in the form of a trough which is open upwardly. This housing 1 is closed by means of a plate-shaped cover 2. The cover is layed on an inner recess 1*a* in the shape of a step of the housing edge 1*b* so that it is surrounded all the way around by the housing edge; thus its surface terminates with the housing edge.

For fastening of the cover, a raised rib 4 with a holding lug 5 on both sides is shaped on a housing intermediate wall 3. Correspondingly, the cover 2 has a recess 6, the wider part 6*a* of which corresponds to the width of the holding lugs 5 and the narrowed part 6*b* of which corresponds to the width of the rib 4. So that the cover can be slid on, the parts 6*a*, or respectively, 6*b* of the recess 6 in each case are somewhat wider than the lugs 5, or the rib 4, respectively.

Figure 2:
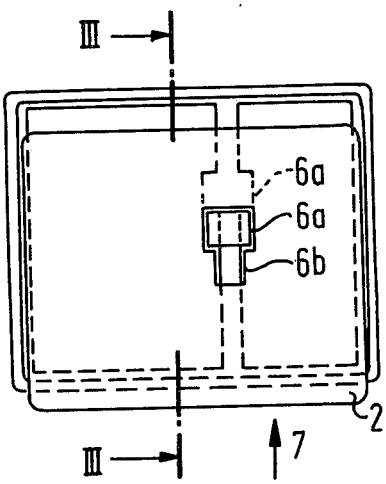
FIGS. 2 and 3 show two views of the housing during sliding on of the cover.
Figure 3:
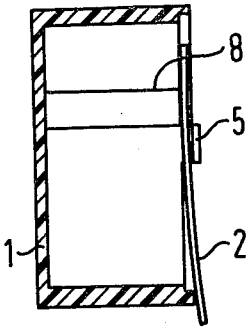

FIGS. 2 and 3 respectively show the sliding on of the cover from above, in section. The cover 2 is placed with the recess 6*a* over the holding lugs 5 and is anchored under the holding lugs 5 by means of displacement in direction of the arrow 7. In order to cover the wide opening 6*a* of the cover which is necessary for the insertion of the cover, a widened rib 8 is provided in the housing. With the cover set on, therefore, the recess 6*a* is brought to lie over this rib 8, so that the interior of the relay is protected against dust.

Figure 4:
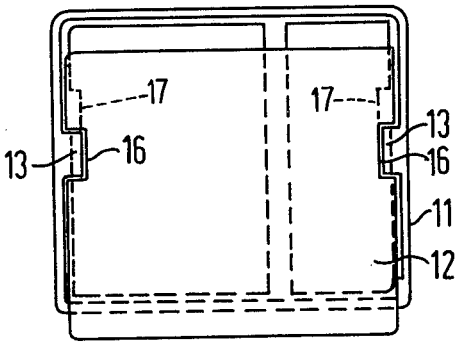
FIG. 4 shows a further embodiment of the housing and the cover.

FIG. 4 shows a further embodiment. The relay housing 11 is in this case provided with two holding lugs 13 which are shaped on edge regions which lie opposite one another. The cover 12 has lateral recesses 16, corresponding in each case to the holding lugs for the insertion. Block out ribs 17 are also provided to cover the recesses 16 when the cover is in position. In an embodiment form which is not further depicted, these recesses 16 could also be left out. In this case, the cover must be pushed through under the holding lugs 13 from the beginning.

In the case of the inventive relay, the cover can be cheaply manufactured as a simple punched part. The cover is protected against falling out upward by means of the holding lugs and laterally by means of the housing edge, even in the case of high impact stresses. Otherwise, the cover can also be removed in a simple manner without disruption in the case of reworking of the relay, and can be replaced again.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An electromagnetic relay, comprising: a trough-shaped base body comprised of an insulating material, the base body serving as a carrier within which are positioned functional elements of the relay; said base body having a peripheral edge with an associated inner recess; a flat cover dimensioned to rest on the inner recess and thereby close the base body; and on the base body two holding lugs shaped which overlap an outer surface of the cover, a direction of overlap for one lug opposing the direction of overlap of the other lug.

2. A relay according to claim 1 wherein the cover has recesses which are displaced in position with respect to the holding lugs when the cover closes the base body and which correspond to their size.

3. A relay according to claim 2 wherein rib means are provided on the base body, which have a cover facing surface which corresponds in size to the recesses, are offset with respect to the lugs, and cover the recesses when the cover is in closing position.

4. A relay according to claim 1 wherein the holding lugs are provided on the base body edge sufficiently above a step portion along the base body edge to permit sliding of the cover into closing position therebetween.

5. A relay according to claim 1 wherein the holding lugs are provided on an intermediate wall at an approximate central location within the base body.

6. A relay according to claim 1 wherein the inner recess forms a step along the peripheral edge of the base body and a periphery of the cover abutting against an inner portion of the peripheral edge so as to prevent lateral movement of the cover when it is in position covering the base body.

7. An electromagnetic relay, comprising: a trough-shaped housing of insulating material; functional elements of the relay within the housing; a peripheral edge formed around an opening of the housing having an inner recess formed as a step; a flat cover dimensioned to rest on the step and close the housing; at a level of the cover, a cover retaining member being provided which is dimensioned to be received through a first recess portion in the cover, said cover retaining member being attached to a base of the housing by a support member via a narrow portion narrower than the cover retaining member; a second recess portion adjoining the first recess portion in the cover being relatively narrower and adapted to receive the narrow portion of the support member; and when the cover is in position on the step, said first recess portion being laterally offset from the cover retaining member and the second recess portion lying beneath the cover retaining member.

8. The relay of claim 7 wherein means are provided extending up from the housing base to cover the first recess portion when the cover is in place to prevent dust entry into the housing.

9. An electromagnetic relay, comprising: a trough-shaped housing of an insulating material; the housing having functional elements of the relay positioned therein; a peripheral edge of the housing at an opening thereof having an associated inner recess formed as a step; a flat cover dimensioned to rest on the step when the cover is in position enclosing the housing; a laterally protruding rib extending from each of opposite sides of the housing peripheral edge and spaced from the step an amount sufficient to permit sliding of the cover between the rib and the step.

10. The relay of claim 9 wherein the cover has a recess of dimensions sufficient to allow an offset placement of the cover on the housing such that the ribs clear the recess, and when the cover is in position the recess being laterally offset from the ribs.

11. The relay of claim 10 wherein means are provided in the housing for covering the recess when the cover is in position to prevent dust entry into the housing.

* * * * *